United States Patent [19]

Larsen

[11] Patent Number: 4,496,128

[45] Date of Patent: Jan. 29, 1985

[54] HANGING DEVICES FOR PICTURES AND THE LIKE

[75] Inventor: Verlyn N. Larsen, Sioux Falls, S. Dak.

[73] Assignee: Design Concepts, Inc., Sioux Falls, S. Dak.

[21] Appl. No.: 414,508

[22] Filed: Sep. 2, 1982

[51] Int. Cl.[3] ..... A47G 1/24

[52] U.S. Cl. ..... 248/496; 40/152.1; 248/477

[58] Field of Search ..... 248/496, 495, 477, 476, 248/220.2, 454; 40/152.1, 617; 403/496

[56] References Cited

U.S. PATENT DOCUMENTS

| | | | |
|---|---|---|---|
| 2,435,225 | 2/1948 | Kolodner et al. | 403/96 |
| 2,483,114 | 9/1949 | Van Schoor et al. . | |
| 3,031,159 | 4/1962 | Waller . | |
| 3,097,444 | 7/1963 | Steiner | 248/454 |
| 3,169,738 | 2/1965 | Johnson | 248/496 |
| 3,871,609 | 3/1975 | Benjamin | 248/496 |
| 4,216,597 | 8/1980 | Kocina et al. | 40/152.1 |
| 4,262,874 | 4/1981 | Seight | 248/496 |
| 4,315,615 | 2/1982 | Scocozza | 248/220.2 |
| 4,330,952 | 5/1982 | Swanson | 40/152.1 |

*Primary Examiner*—William H. Schultz
*Assistant Examiner*—Ramon O. Ramirez

[57] ABSTRACT

Hanging devices for pictures and the like, comprising a pair of generally triangular shaped members, each member preferably having a generally right triangle configuration with a raised hypotenuse edge having an irregular or sawtooth edge surface. The triangular members are adapted for respective attachment proximate the top corners of a picture or the like, with the irregular edge facing generally downwardly so as to engage against a pair of spaced-apart nails or other projections attached to a wall. Picture leveling can be straightforwardly accomplished by a slight lateral positioning of the picture to permit selective engagement between the nails and the sawteeth along the respective edges.

7 Claims, 11 Drawing Figures

HANGING DEVICES FOR PICTURES AND THE LIKE

BACKGROUND OF THE INVENTION

The present invention relates generally to devices for hanging pictures and the like, and more specifically to a pair of devices which may be respectively mounted against the back side of a frame in spaced-apart relationship to permit both hanging and leveling of the frame.

A great many devices for hanging picture frames and the like may be found in the prior art. For example, U.S. Pat. No. 4,262,874, issued Apr. 21, 1981 discloses a curved notched hanger for attachment to the back of a plate, for permitting hanging of the plate and some degree of orientation of the plate on the hanger. A number of prior art patents disclose notched hanger devices for attachment to a back of a picture frame, usually proximate the center of the frame, for permitting hanging while allowing some degree of lateral shifting along the hanger to assist in leveling the frame. Among these patents is U.S. Pat. No. 3,218,747, issued Nov. 23, 1965; U.S. Pat. No. 3,031,159, issued Apr. 24, 1962; U.S. Pat. No. 2,483,114, issued Sept. 27, 1949; and U.S. Pat. No. 2,641,427, issued June 9, 1953. All of the foregoing devices require a certain accuracy in mounting the hanger on the frame, since the frame is suspended from a single mounting point contact with the hanger, and is therefore dependent upon the weight distribution of the frame. By contrast, U.S. Pat. No. 3,169,738, issued Feb. 16, 1965 discloses an elongated curved bracket having two notched edge portions for attachment to the back of a frame, and a second elongated horizontal bracket for mounting against a wall. Lateral shifting between the two brackets permits some degree of leveling and also permits two point suspension of the frame. However, these brackets must be constructed very large, and hence costly, in order to effectively level large frames, and the wall bracket covers a considerable wall surface area in order to provide the simple function of providing two contact suspension points for the picture brackets.

In order to provide suitable functions by way of serving both as a picture hanger and positive leveling mechanism, a hanging device should be amenable to attachment to any size picture frame, should require a wall attachment mechanism which will cause as little damage or defacing of the wall surface as possible, should be simple to install and should provide leveling and support for the picture at widely spaced points—preferably at the extreme corners of the picture frame. None of the aforementioned devices completely meet these requirements and there is therefore a need for picture hanging devices which can fullfill all of these functions. Further, there is a need for picture hanging devices meeting all of the above functional requirements, and which are adaptable for use with a number of different frame designs which have become commercially successful in recent years.

SUMMARY OF THE INVENTION

The invention comprises a pair of notched, generally triangular members, adapted for attachment to respective top corners of a frame. Each member has a generally downwardly facing notched edge, permitting engagement against a nail or other attachment projecting from a wall surface, thereby permitting two point supporting suspension for the frame, while allowing for lateral shifting of the frame to provide positive leveling. The generally triangular members may be adapted to a wide variety of frame designs, and the embodiments include a generalized embodiment which is adaptable for common frame types.

It is a principal object of the present invention to provide a hanging device for pictures and the like for permitting two point suspension of the frame and for permitting positive leveling of the frame.

Still further, the present invention offers the advantage of completely eliminating any need for picture hanging wires, cords or the like.

It is a further object of the present invention to provide a picture hanging device which permits the mounting and level hanging of pictures without requiring precise measurements of the hanging members, and without requiring wires, cords or the like.

It is another object of the present invention to provide a number of embodiments of hanging devices which are adaptable for various commercially available and special frame designs.

BRIEF DESCRIPTION OF THE DRAWINGS

The foregoing and other objects of the invention will become apparent upon a reading of the following specification, with reference to the appended claims and the drawings, in which:

DESCRIPTION OF THE PREFERRED EMBODIMENT

Figure 1B:
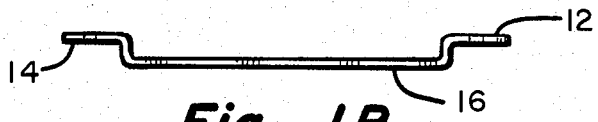
FIG. 1B shows a top view of FIG. 1A.
Figure 1C:
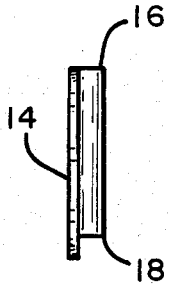
FIG. 1C shows a left side view of the member of FIG. 1A.
Figure 1A:
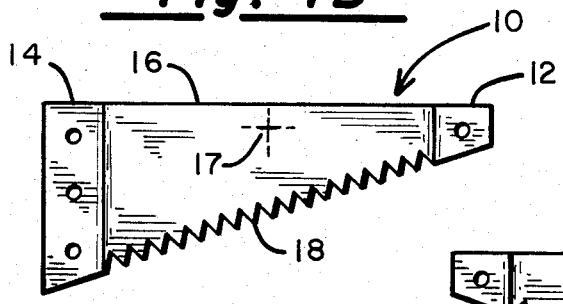
FIG. 1A shows a preferred embodiment of one member of the invention.
Figure 1D:
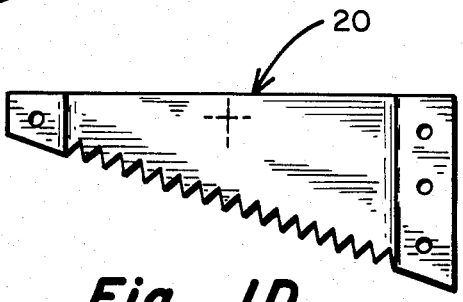
FIG. 1D shows a second member of the invention.

Referring first to FIG. 1A–FIG. 1C, there is shown a member 10 in several views. Member 10 is generally triangular in shape, and is preferably formed in the shape of a right triangle. Member 10 has a raised surface portion 16, with two recessed end portions 12 and 14. End portions 12 and 14 have one or more holes 13 therethrough for accepting mounting hardware. A lower raised edge 18 is constructed with a plurality of notches to be hereinafter described. It is preferable that a mark 17 be included at a suitable centered point along the raised surface of member 10. FIG. 1D shows a second member 20, which is generally constructed as a mirror image of member 10. In practice, member 10 would preferably be labeled "left" and member 20 would be preferably labeled "right", so as to indicate their preferred attachments respectively to the left hand and right hand rear corners of a picture frame.

In the embodiments shown in FIGS. 1A–1D, the interior triangular angles are in the range of 75°/15°. Other triangular relationships could be utilized, including a triangular relationship of 45°/45°. The primary function of the triangular shape of the invention is to provide a predetermined amount of vertical displacement for a given amount of lateral shifting of the frame after the members have been mounted. The more nearly equal the interior angles of the triangular shape, the more nearly will lateral displacement equal vertical displacement when the frame is subsequently positioned on the wall.

Figure 2B:
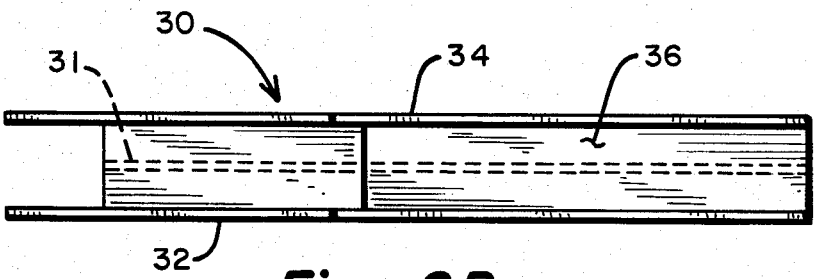
FIG. 2B shows a top view of the embodiment of FIG. 2A.
Figure 2C:
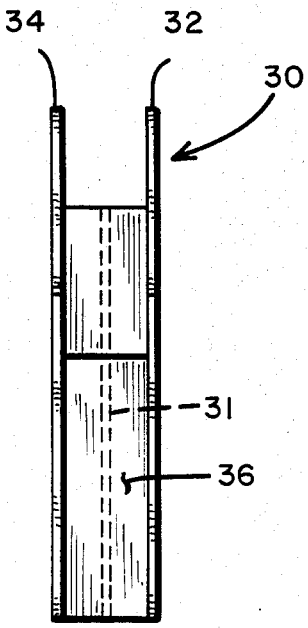
FIG. 2C shows a left hand view of the embodiment of FIG. 2A.
Figure 2A:
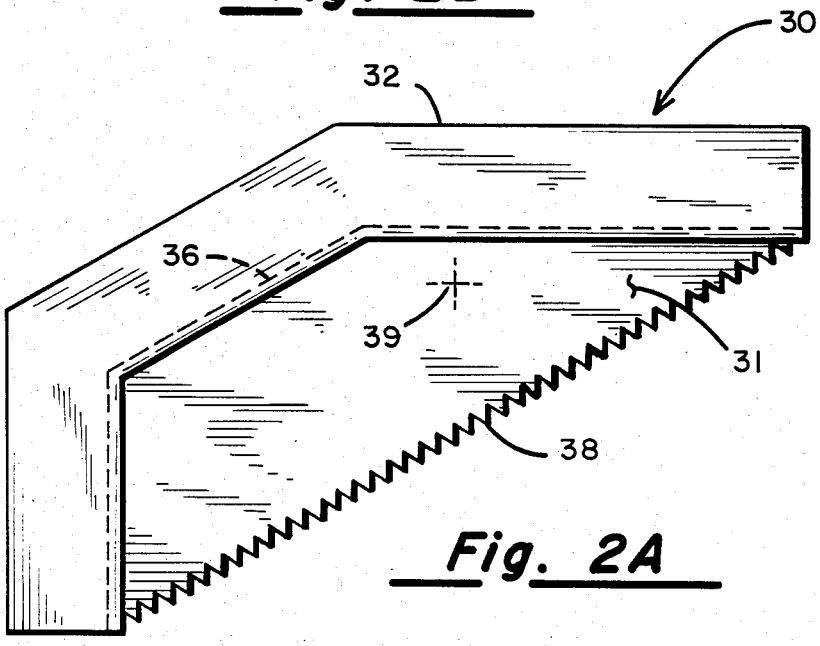
FIG. 2A shows a further embodiment of the invention.
Figure 3B:
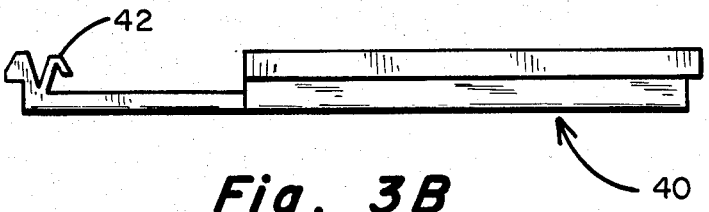
FIG. 3B shows a top view of the embodiment of FIG. 3A.
Figure 3C:
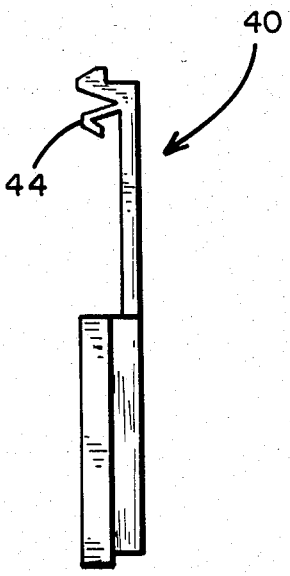
FIG. 3C shows a left side view of the embodiment of FIG. 3A.
Figure 3A:
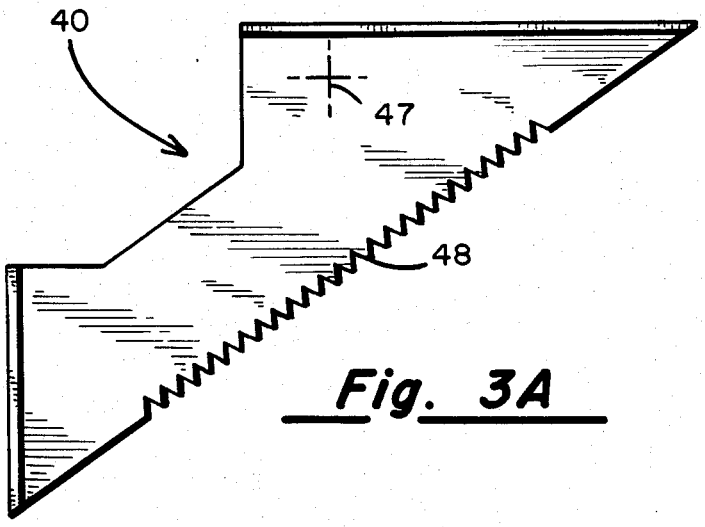
FIG. 3A shows a further embodiment of the invention.
Figure 3D:
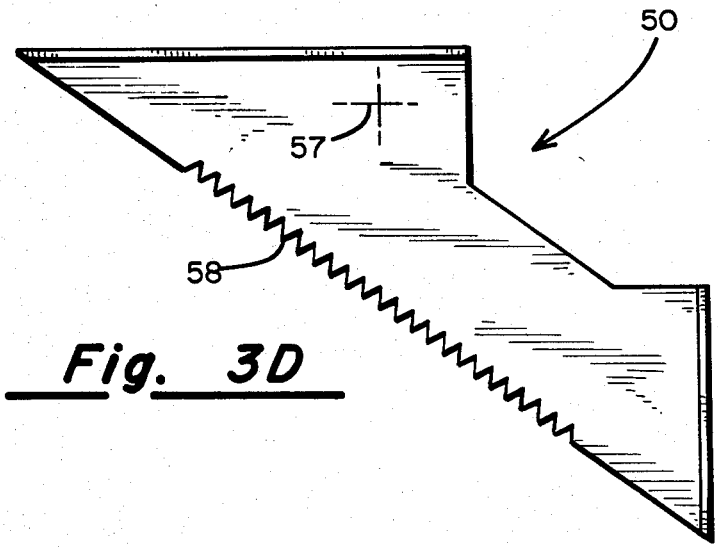
FIG. 3D shows another member of the present invention.

FIGS. 2A–2C show another embodiment of the invention, particularly adaptable for attachment to wood artists stretcher frames. Frames of this type are commonly found in commerce, as for example a frame manufactured by M. Grumbacher, Inc. of New York, N.Y. Typically, these frames are rectangular wood members constructed from wood having a thickness of approximately § inch. Member 30 is adapted for nesting over such a frame, having front and rear spaced-apart edges 32 and 34 which are spaced-apart to form a suitable groove for accepting a portion of the frame assembly. An inside wall 36 is rigidly affixed between front and rear edges 32 and 34 to form the proper spacing. A plate 31 has a diagonal notched edge 38 and is attached between vertical and horizontal edges, it being preferred that a mark 39 be included on the surface of the plate 31 proximate the center of notched edge 38. The diagonal line along which edge 38 is formed is angled with respect to the vertical and horizontal edges to provide a predetermined vertical displacement for a predetermined lateral shifting of the frame. Member 30 may be reversibly used to attach to two top frame corners. When a pair of members 30 are properly nested within the rectangular frame assembly, they together permit positive two-point suspension of the frame and, with lateral shifting, positive leveling of the frame.

FIGS. 3A–3D shows a further embodiment of the invention, particularly adapted for use in connection with metal section picture frames, such as frames manufactured by Neilson Moulding Design Corporation, Townsend, Mass. Member 40 is generally triangular in shape, with suitable cutouts and channels for fitting into and accepting metal picture frame sections. For example, a channel 42 is adapted for slidable attachment to a vertical picture frame section and a channel 44 is designed for slidable acceptance of a horizontal metal picture frame section. Member 40 is fitted on the respective metal picture frame sections, so as to become rigidly attached at the upper left hand corner of the picture frame assembly. Similarly, member 50 includes the same channels and construction features so as to permit rigid attachment to the upper right hand corner of the metal picture frame assembly. Member 40 has a generally downwardly facing notched edge 48, and member 50 has a generally downwardly facing notched edge 58. Together, these notched edges may engage a pair of spaced nails or similar attachment devices secured to the wall, to provide lateral and vertical fixation of the frame against the wall. Preferably, member 40 has a mark 47 placed proximate the center of notched edge 48, and member 50 has a mark 57 placed proximate the center of notched edge 58. After the respective members have been affixed to the frame, a simple measurement of the spacing between the respective marks provides a precise measurement of the proper spacing of the nails or other attachment devices which are secured to the wall. While these measurements may be made precisely, the nature of the invention does not require precise measurement, for slight errors in measurement are easily compensated for by merely adjusting the lateral position of the frame.

In operation, each of the embodiments described herein are first affixed to a picture frame or the like. Members 10 and 20 are affixed by nailing or tacking respectively to the left and right hand upper corners of the rear of the frame. A pair of members 30 are respectively affixed by nesting to the interior upper inside corners of the rectangular wooden frame assembly. Members 40 and 50 are respectively affixed to metal frame sections by slidable engagement with the metal sections at the upper right and upper left hand rear corners of the metal frame.

After the respective embodiments have been affixed to the frame as hereinbefore described, a measurement is made between the marks on the respective members, to ascertain the proper spacing for supporting nails or screws to be attached to the wall. A pair of nails or other fasteners are attached at the measured distance, and the picture frame is hung against these nails or screws wherein engagement is made with the notched edges of the respective members. It is apparent that the nails or other fasteners need not be precisely aligned in either height or spacing, for the invention is adaptable to accept variations in misalignment. Leveling of the frame is thereafter accomplished by merely laterally shifting left or right, to cause successive engagement with different notches and to thereby vertically shift the position of the frame.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. Apparatus for hanging and leveling picture frames and the like, comprising a pair of generally triangular shaped members, each such member having means for attachment to a picture frame proximate a top rear corner comprising an edge channel adapted for nesting about said frame; each member further comprising a notched edge surface along a diagonal line which is the longest edge of said triangular shape.

2. The apparatus of claim 1, wherein said edge channel further comprises first and second sections orthogonally aligned and adapted for nesting about a frame such that the frame corner is positioned at the intersection of said channel sections' orthogonal alignment.

3. The apparatus of claim 2, wherein said generally triangular shaped members further comprise a generally right triangle shape, and said notched edge surface is formed along a line which is parallel to the hypotenuse edge of said right triangle.

4. Apparatus for hanging and leveling picture frames and the like, comprising a pair of generally triangular shaped members, each such member having means for attachment to a picture frame proximate a top rear corner comprising channel guides adapted for slidable engagement with metal picture frame sections; each member further comprising a notched edge surface along a diagonal line which is the longest edge of said triangular shape.

5. The apparatus of claim 4, wherein said channel guides further comprise first and second sections orthogonally aligned and adapted for orthogonal attachment to respective picture frame sections such that the intersection of said sections corresponds to the orthogonal intersection of said first and second sections.

6. The apparatus of claim 5, wherein said generally triangular shaped members further comprise a generally right triangle shape, and said notched edge surface is formed along a line which is parallel to the hypotenuse edge of said right triangle.

7. The apparatus of claim 6, wherein said right triangle acute angles are in the range of 15 degrees to 75 degrees.

* * * * *